US006422696B1

(12) United States Patent
Takahashi et al.

(10) Patent No.: US 6,422,696 B1
(45) Date of Patent: Jul. 23, 2002

(54) RECORDING METHOD AND APPARATUS FOR FORMING AN IMAGE ON A POWDER LAYER UNIFORMLY DISTRIBUTED ON AN INTERMEDIATE TRANSFER MEMBER

(75) Inventors: Tomoko Takahashi, Kanagawa; Mitsuo Hasebe, Tokyo; Toshio Kawakubo; Makoto Hino, both of Kanagawa, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/525,051

(22) Filed: Mar. 14, 2000

(30) Foreign Application Priority Data

Mar. 23, 1999 (JP) ..... 11-078301
Mar. 30, 1999 (JP) ..... 11-089921

(51) Int. Cl.[7] ..... B41J 2/01
(52) U.S. Cl. ..... 347/103
(58) Field of Search ..... 347/103, 94, 93; 399/302, 312, 313, 162, 308, 266

(56) References Cited

U.S. PATENT DOCUMENTS

| | | | | |
|---|---|---|---|---|
| 4,868,600 A | * | 9/1989 | Hays et al. | 399/266 |
| 5,057,871 A | * | 10/1991 | Hirose et al. | 355/259 |
| 5,801,729 A | * | 9/1998 | Kitamura et al. | 347/55 |
| 6,226,481 B1 | * | 5/2001 | Yoneda et al. | 399/227 |

FOREIGN PATENT DOCUMENTS

| | | | |
|---|---|---|---|
| JP | 5-096720 | | 4/1993 |
| JP | 6-092009 | | 4/1994 |
| JP | 6-092010 | | 4/1994 |
| JP | 7-089067 | | 4/1995 |
| JP | 11-188858 | | 7/1999 |
| JP | 11188858 | * | 7/1999 |

OTHER PUBLICATIONS

U.S. application No. 09/525,051, filed Mar. 14, 2000, pending.

* cited by examiner

*Primary Examiner*—John Barlow
*Assistant Examiner*—Ly T Tran
(74) *Attorney, Agent, or Firm*—Oblon, Spivak, McClelland, Maier & Neustadt, P.C.

(57) ABSTRACT

A recording apparatus can apply an appropriate amount of setting agent, which is in the form of powder, to an intermediate transfer member. The setting agent is provided to a plurality of depressions formed on an application roller and transferred onto the intermediate transfer member, or formed on the intermediate transfer member, which moves the setting agent to a position where a visible image is formed by applying the droplets of a liquid onto the setting agent. The setting agent increases the viscosity of droplets of the liquid for forming the visible image to be transferred to a recording medium. The visible image formed on the setting agent is transferred onto the recording medium.

20 Claims, 6 Drawing Sheets

RECORDING METHOD AND APPARATUS FOR FORMING AN IMAGE ON A POWDER LAYER UNIFORMLY DISTRIBUTED ON AN INTERMEDIATE TRANSFER MEMBER

BACKGROUND OF THE INVENTION

1. Field of the Invention

The present invention generally relates to recording apparatuses and, more particularly, to a recording apparatus, such as an inkjet recording apparatus, which ejects droplets of a liquid onto an intermediate transfer member to form a visible image and transfers the visible image to a recording medium such as a sheet of recording paper.

2. Description of the Related Art

In the inkjet recording method in which an ink image is formed by projecting ink droplets in accordance with image signals, high quality paper must be used as a recording medium so that the ink does not run on or penetrate into the recording medium. In order to solve the problem with respect to the ink running on the recording medium, the following methods have been suggested.

1) Japanese Laid-Open Patent Applications No. 6-92009 and No. 6-92010 disclose a method in which an ink curing agent is applied onto ink droplets at the same time or immediately before or after the ink droplets are applied to a sheet of recording paper. That is, in order to prevent the ink from running, droplets of the ink curing liquid are applied to a position on a sheet of regular paper, to which position the ink droplets are applied, at the same time or immediately before or after the ink droplets are applied to that position. This method requires an additional mechanism for applying droplets of the ink curing liquid. Additionally, there is a drawback in that the recording time interval is longer than the recording time interval of the conventional inkjet recording method due to the curing time of the ink curing liquid.

2) Japanese Laid-Open Patent Application No. 5-96720 discloses a fixing method in which an ink image is provided on a sheet of recording paper after a material which reduces running of ink is applied to the surface of the recording paper, and thereafter the ink image is fixed to the sheet of recording paper. That is, particles made of the material, which reduce running of ink, are previously applied to the surface of the sheet of regular paper, and an ink image imagine is fixed to the layer of the particles. After the ink image is fixed, the particles also become fixed to the sheet of recording paper. The material of the particles used in this method dissolves into the ink, and, thereby, the particles may react with an ink solvent such as water or oil on the sheet of recording paper. Thus, there is a problem in the stability of the ink image during storage of the recording paper after the ink image is recorded.

3) Japanese Laid-Open Patent Application No. 7-89067 discloses a method performed by an inkjet recording apparatus using an intermediate transfer member. In this method, an ink image is formed on the intermediate transfer member, and the ink image is transferred onto a sheet of recording paper after the viscosity of the ink image is increased to an appropriate level so as to solve the problem with respect to running of ink on the recording paper. In this method, a surface active agent is previously applied to the surface of the intermediate transfer member so as to increase the wetting characteristic of the surface of the intermediate transfer member. Thus, it takes a considerable time interval for the ink image to achieve an appropriate viscosity. This may cause running of ink on the intermediate transfer member and also on the recording paper, and, thus, this method is not suitable for a high-speed recording. Especially, running of ink is more likely when the ink image is a large, high-intensity image. Accordingly, an inkjet recording apparatus using this method has a limit in increasing the recording speed due to the running of ink.

4) Japanese Laid-Open Patent Application No. 11-188858 discloses an inkjet recording method which solves the problems of the above-mentioned methods. In this method, a powder is applied to a recording medium before an ink image is formed on the recording medium. The material of the powder is soluble into or swollen by a solvent contained in the ink so that the viscosity of the ink droplets is increased, and the material does not react with the die or pigment contained in the ink. Since the ink droplets are applied onto the layer of the powder applied on the intermediate transfer member so as to form a visible image, a high quality ink image can be transferred onto a sheet of regular paper at a high speed without ink running.

The diameter of the powder particles used in this method is in the order of less than one micrometer. Accordingly, in order to apply a sufficient amount of powder to absorb the liquid contained in the ink droplets, the powder on the intermediate transfer member must be formed in a multi-layered structure in which each layer has a thickness corresponding to the diameter of the powder particles. If a sufficient amount of the liquid contained in the ink droplets is not absorbed by the powder, running of ink may occur when the ink image is transferred onto the recording paper. Thus, in order to apply the powder in a multi-layered structure with a uniform thickness, an extremely high accuracy is required of the mechanism applying the powder to the intermediate transfer member.

Additionally, when the powder remaining on the intermediate transfer member after the transfer of the ink image to the recording paper is not removed and is therefore reused in the subsequent image forming process by replenishing the necessary amount of powder by an application roller, the thickness of the powder layer tends to become uneven. Such unevenness in the thickness of the powder layer may cause the incomplete transfer of the ink image to the recording paper. Accordingly, in order to eliminate such a problem, the powder remaining on the intermediate transfer member is removed by a removing member such as a blade or a brush. However, normally, the amount of powder on the intermediate transfer member which is not used for forming an ink image is much larger than the amount of powder actually used for forming the ink image. Thereby, if the remaining powder is removed and not reused for the subsequent image forming process, there is a problem in that an extremely large amount of powder is consumed by the inkjet recording apparatus, resulting in an increase in the running cost of the inkjet recording apparatus. Accordingly, it is preferable to reuse the removed powder. However, there is a problem in that the removed powder contains both powder which has not been in contact with the ink droplets and powder which has been swollen due to contact with the ink droplets but has not been transferred to the recording paper. Therefore, the two kinds of powder must be separated from each other.

SUMMARY OF THE INVENTION

It is a general object of the present invention to provide an improved and useful recording apparatus and method in which the above-mentioned problems are eliminated.

A more specific object of the present invention is to provide a recording apparatus and method in which an appropriate amount of powder can be applied to an intermediate transfer member, the powder absorbing a liquid for forming an image to be transferred to a recording medium.

In order to achieve the above-mentioned objects, a setting agent is supplied to a carrier which then carries the setting agent, a part of the carrier having a plurality of depressions receiving the setting agent. The setting agent is made of a material in the form of powder that increases the viscosity of the droplets of the liquid by being dissolved into the liquid or absorbing the liquid. A visible image is formed on the setting agent carried by the carrier by applying the droplets of the liquid onto the setting agent. The visible image formed on the setting agent is transferred onto a recording medium.

According to the present invention, since the setting agent is placed in the depressions, the amount of the setting agent moved to the image forming position is determined by the size and number of the depressions. Thus, the amount of the setting agent moved to the image forming position can be easily set to an appropriate amount which is sufficient for increasing the viscosity of the droplets so that there is no running in the visible image formed by the droplets of the liquid whose viscosity is increased by the appropriate amount of the setting agent.

In one embodiment of the present invention, the setting agent is applied to an application roller having a surface on which the depressions are formed so that the setting agent is received by the depressions. Then, the setting agent carried by the depressions of the application roller is transferred onto an intermediate transfer member which carries and moves the setting agent to a position where the droplets of the liquid are applied.

In another embodiment of the present invention, the setting agent is applied to an intermediate transfer member having a surface on which the depressions are formed so that the setting agent is received by the depressions. Then, the setting agent is squeezed into the depressions of the intermediate transfer member.

Other objects, features and advantages of the present invention will become more apparent from the following detailed description when read in conjunction with the accompanying drawings.

DETAILED DESCRIPTION OF THE PREFERRED EMBODIMENTS

Figure 1:
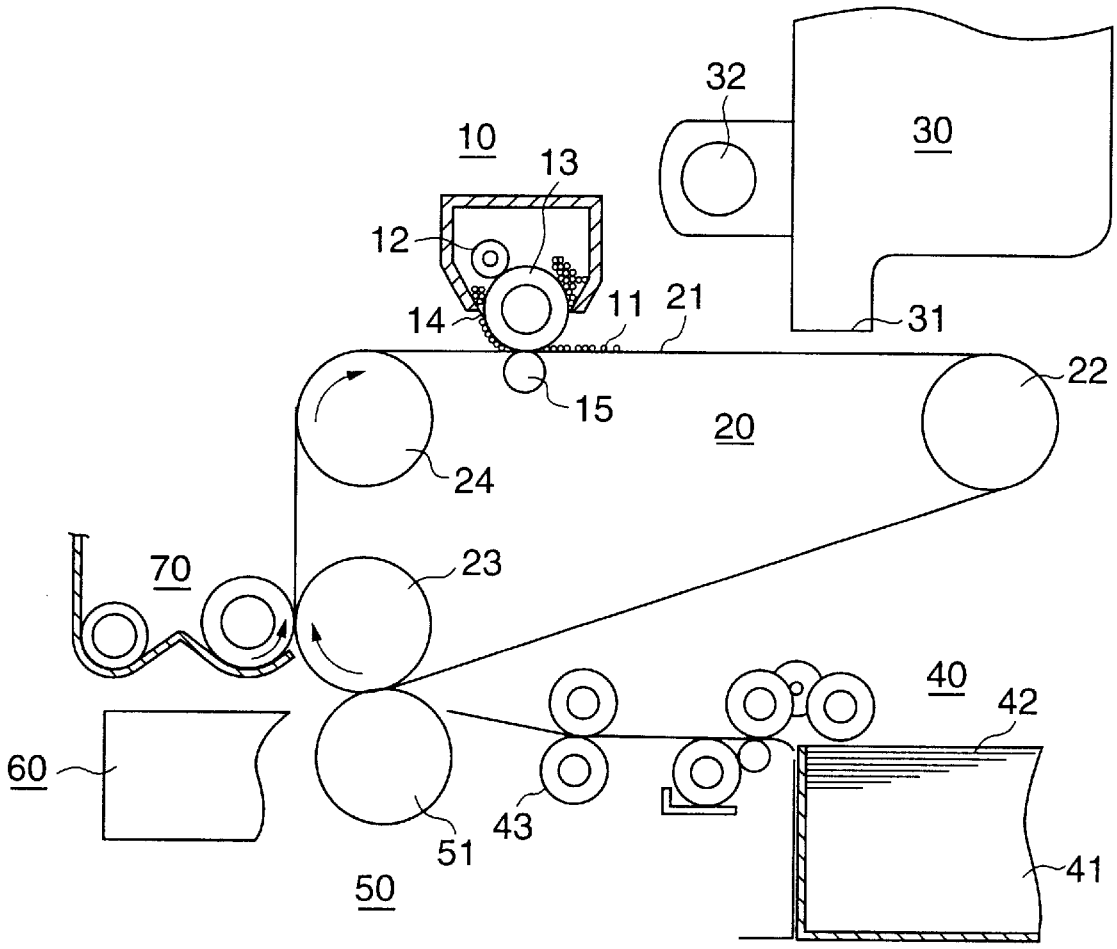
FIG. 1 is a schematic illustration of an inkjet recording apparatus according to a first embodiment of the present invention.

A description will now be given, with reference to FIG. 1, of a first embodiment of the present invention. FIG. 1 is a schematic illustration of an inkjet recording apparatus according to the first embodiment of the present invention.

The inkjet recording apparatus according to the first embodiment of the present invention comprises: a setting agent applicator 10 for applying a setting agent to an intermediate transfer belt 21 as an intermediate transfer member; an intermediate transfer mechanism 20 including the intermediate transfer belt 21; a printing mechanism 30 for projecting droplets of an image forming liquid such as ink onto the intermediate transfer belt 21; a paper feed mechanism 40 for feeding a sheet-like recording medium such as recording paper 42; a transfer mechanism 50 for transferring a visible image from the intermediate transfer belt 21 to the recording paper 42; an ejecting mechanism 60 for ejecting the recording paper 42 from the apparatus; and a setting agent removing mechanism 70 for removing the setting agent from the intermediate transfer belt 21.

In the recording apparatus according to the present embodiment, the setting agent applicator 10 applies the setting agent 11 to the intermediate transfer belt 21 of the intermediate transfer mechanism in accordance with a recording start signal supplied by a control unit (not shown in the figure). The setting agent 11 is made of a material having a liquid absorbing property such as an acrylic acid resin, a copolymer resin of acrylic acid and methacrylic acid, a methacrylic acid resin or a starch. The setting agent 11 is in the form of powder having a particle diameter in the range from 0.1 micrometers to 30 micrometers.

An operation of the intermediate transfer mechanism 20 is started simultaneously with an operation of the setting agent applicator 20 so that the setting agent 11 is applied to the intermediate transfer belt 21 while the intermediate transfer belt 21 is cycling. The details of the operation to apply the setting agent 11 will be described later.

The surface of the intermediate transfer belt 21 is made of an elastic material such as silicon rubber, fluorocarbon rubber or epichlorohydrin rubber. However, a layer of such an elastic material may be provided on a belt-like member made of a resin such as poly(ethylene terephthalate) (PET) or polyimide. The intermediate transfer belt 21 may be replaced by a metal drum having a surface layer made of the above-mentioned elastic material. The intermediate transfer mechanism 20 comprises: the intermediate transfer belt 21; rollers 22, 23 and 24 for cyclying the intermediate transfer belt 21; a drive motor (not shown in the figure) for driving one of the rollers 22, 23 and 24; an encoder (not shown in the figure) for controlling a position of the intermediate transfer belt 21; and a housing (not shown in the figure). The intermediate transfer belt 21 is engaged with the rollers 22, 23 and 24 so that the intermediate transfer belt 21 is cycled by a rotational force generated by the drive motor.

After the setting agent 11 is applied to the intermediate transfer belt 21, and the setting agent 11 on the intermediate transfer belt reaches a position at which an image forming liquid is projected onto the intermediate transfer belt 21, the printing mechanism 30 starts to form an image on the layer of the setting agent 11 applied on the intermediate transfer belt 21. In the present embodiment, the printing mechanism 30 comprises an inkjet head 31 which moves along a bar member 32 in a direction perpendicular to the direction of movement of the intermediate transfer belt 21. The printing operation of the image on the intermediate transfer belt 21 can be performed by a line head which can form an image on the layer of the setting agent 11 at a high speed.

At the same time, a sheet of recording paper 42 is fed from a paper supply cassette 41 of the paper supply mechanism 40, and the sheet of recording paper 42 is conveyed to a register roller 43. Then, the sheet of recording paper 42 is fed by the register roller 43 in synchronization with the movement of the intermediate transfer belt 21. The sheet of recording paper 42 is pressed against the intermediate transfer belt 21 by a transfer roller 51 of the transfer mechanism 50 so that the image formed on the layer of the setting agent 11 on the intermediate transfer belt 21 is transferred onto the sheet of recording paper 42. Thereafter, the sheet of recording paper 42 having the image is ejected from the recording apparatus by the eject mechanism 60.

A part of the setting agent 11 contacting the image forming liquid is transferred onto the recording paper 42, but remaining part of the setting agent 11 which was not associated with the formation of the image transferred onto the recording paper 42 remains on the intermediate transfer belt 21. Normally, the remaining part of the setting agent 11 is not removed from the intermediate transfer belt 21, and is used for the subsequent image forming process by replenishing the amount of the used setting agent 11 from the setting agent applicator 10. However, if the recording apparatus is not used for a long time, it is better to remove the setting agent 11 remaining on the transfer belt 21 using the setting agent removing mechanism 70 since the setting agent 11 may absorb moisture from the atmosphere.

A description will now be given of the setting agent applicator 10 shown in FIG. 1.

The setting agent applicator 10 comprises a supply brush 12, an application roller 13 and a squeezer 14. An amount of setting agent 11 applied to the application roller 13 is controlled by the amount of setting agent 11 supplied by the supply brush 12 and the magnitude of a pressure applied to the setting agent 11 by the squeezer 14. The controlled amount of setting agent 11 is retained by the application roller 13, and is continuously provided to the intermediate transfer belt 21.

As shown in FIG. 1, a stainless steel roller 15 is situated on the opposite side of the intermediate transfer belt 21 with respect to the application roller 13 so as to press the intermediate transfer belt 21 against the application roller 13. The stainless steel roller 15 may be replaced by other members such as a plate-like member if an appropriate contact can be achieved between the intermediate transfer belt 21 and the application roller 13.

Figure 2:
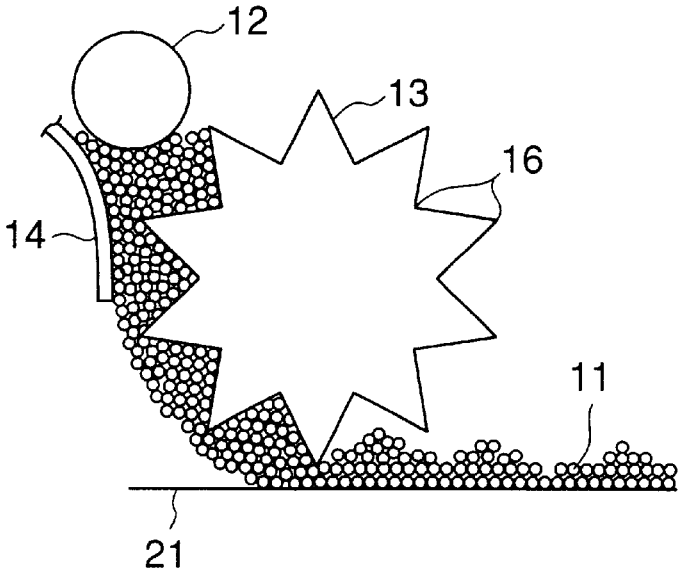
FIG. 2 is an illustration for explaining an operation of a setting agent applicator shown in FIG. 1.

A description will now be given, with reference to FIG. 2, of the operation of application of the setting agent 11 to the intermediate transfer belt 21. The surface of the application roller 13 is provided with unevenness 16 (enhanced in FIG. 2) so that the setting agent 11 is squeezed into the depressions formed on the surface of the application roller 13 by a pressure applied by the squeezer 14. Accordingly, a predetermined amount of setting agent 11, which is in the form of powder, forms a lump of powder due to a cohesive force between the particles of the setting agent 11. When the outermost portion of the lump of setting agent 11 contacts the surface of the intermediate transfer belt 21, the lump of setting agent 11 moves onto the surface of the intermediate transfer belt 21 due to an adhesive force of the surface of the intermediate transfer belt 21. Accordingly in this embodiment, a predetermined amount of setting agent can be easily applied to the intermediate transfer belt 21. That is, a predetermined amount of setting agent 11 can be continuously applied to the intermediate transfer belt 21 in the form of a multi-layered structure.

Figure 3A:
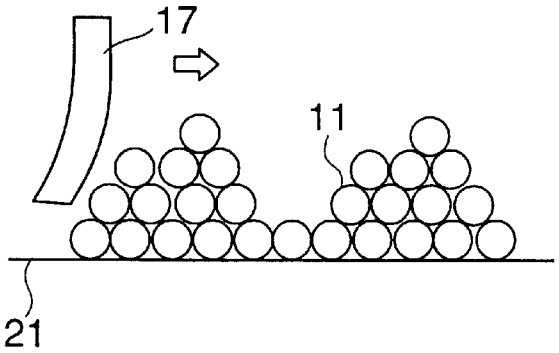
FIGS. 3A and 3*b* are illustrations for explaining a leveling operation performed by a blade.
Figure 3B:
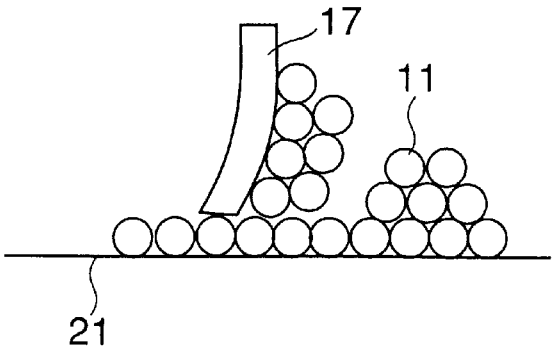

If the setting agent 11 is applied to the intermediate transfer belt 21 as shown in FIG. 3A and is leveled by a blade 17 as shown in FIG. 3B by moving the blade 17 in a direction of the arrow in FIG. 3A, the force applied by the blade 17 may separate the particles of the setting agent 11 from each other. Thus, only a single layer of the particles of the setting agent 11 may remain on the intermediate transfer belt 21. This is because the adhesive force of the surface of the intermediate transfer belt 21 exerted on each of the particles of the setting agent 11 is larger than the cohesive force between the particles of the setting agent 11. Accordingly, in order to retain the setting agent 11 on the intermediate transfer belt 21 in the form of a multi-layered structure, it is important to eliminate a force which moves each particle of the setting agent 11. That is, it is preferable that the setting agent 11 not be contacted by any member after the predetermined amount of setting agent 11 is applied onto the intermediate transfer belt 21.

The unevenness of the surface of the application roller 13 can be regular unevenness or irregular unevenness. The unevenness can be formed by sand blasting the surface of the application roller 13 which is made of an elastic member such as silicon rubber, ethylene propylene rubber (EPDM) or urethane rubber, or a solid member made of metal such as aluminum or stainless steel or a resin such as polycarbonate. Alternatively, the unevenness can be a surface of foamed material such as foamed rubber or foamed urethane.

It should be noted that the setting agent applicator 10 may comprise a belt-like member instead of the application roller 13. If the application roller 13 is formed of a rigid member, the application roller 13 can be manufactured in a simple structure at a low cost. On the other hand, if the application roller 13 is made of an elastic member, the contact area between the application roller 13 and the intermediate transfer belt 21 can be large and a uniform pressure can be generated in the contact area.

In order to confirm the effects of the present invention, the following tests were conducted by the inventors.

TEST 1

An inkjet printer using water soluble ink was used as the recording apparatus in which an image is formed on the intermediate transfer belt. As for the recording paper, print paper designated as TYPE6200 manufactured by Ricoh Co., Ltd. was used. The setting agent was made from poly(acrylic acid) resin in the form of powder having an average particle diameter of about 5 micrometers. As for the supply brush 12 of the setting agent applicator 10, an acrylic brush was used. The application roller 13 was a roller having a surface layer made of foamed silicon rubber. An average diameter of the cells in the foamed silicon rubber was about 100 micrometers, and the hardness of the foamed silicon rubber was about 40 degrees according to JIS-A scale. As for the intermediate transfer belt 21, a belt made of silicon rubber was used.

Under the above-mentioned conditions, the application roller 13 was cycled while being brought into contact with the intermediate transfer belt 21 so as to transfer the setting agent supplied by the supply brush 12 onto the intermediate transfer belt 21. The amount of the setting agent adhering to the intermediate transfer belt 21 was about 100 micrograms per square centimeters (100 $\mu g/cm^2$). It was observed that the setting agent on the intermediate transfer belt was in the form of a multi-layered structure. In this state, an ink image was formed on the layer of the setting agent on the intermediate transfer belt 21 by the inkjet printer, and the ink image was transferred onto the recording paper. A good quality image was obtained on the recording paper and the ink image was almost entirely removed from the intermediate transfer belt 21. importantly, no ink running was observed in the first, second and third color ink images transferred onto the recording paper.

For the purpose of comparison, a blade made of urethane was provided at a position between the setting agent applicator 10 and the printing mechanism 30 so as to level the setting agent 11 on the intermediate transfer belt 21 as shown in FIGS. 3A and 3B. Most part of the setting agent collected on the upstream side of the blade, and slipped off of the intermediate transfer belt 21. An ink image was formed on the intermediate transfer belt 21 in the same manner by the inkjet printer, and the ink image was transferred onto the recording paper. No ink running was observed in the transferred first color ink image and a good image quality was obtained. However, ink running was observed in the second and third color ink images transferred.

TEST 2

An inkjet printer using water soluble ink was used as the recording apparatus in which an image was formed on the intermediate transfer belt. As for the recording paper, print paper designated as TYPE6200 manufactured by Ricoh Co., Ltd. was used. The setting agent was made from poly(acrylic acid) resin in the form of powder having an average particle diameter in the range from 2 micrometers to 3 micrometers. As for the supply brush 12 of the setting agent applicator 10, an acrylic brush was used. The application roller 13 was an aluminum roller having a surface treated by sand blasting. Two kinds of aluminum rollers were used, one having a surface whose surface roughness Rz is 60 micrometers and the other having a surface whose surface roughness Rz is 100 micrometers. When the aluminum roller having the surface of whose surface roughness Rz is 60 micrometers was used, the amount of setting agent adhering to the intermediate transfer belt was 90 $\mu g/cm^2$. When the aluminum roller having the surface whose surface roughness Rz is 100 micrometers was used, the amount of setting agent adhering to the intermediate transfer belt was 150 $\mu g/cm^2$. In either case, the setting agent adhered to the intermediate transfer belt in the form of a multi-layered structure, and the layer of the setting agent did not separate from the intermediate transfer belt prior to an ink image being formed on the layer of the setting agent, which resulted in a good quality image. Another advantage of the formation of unevenness on the surface of the application roller was to provide an application roller having a simple structure at a low cost.

TEST 3

Figure 4:
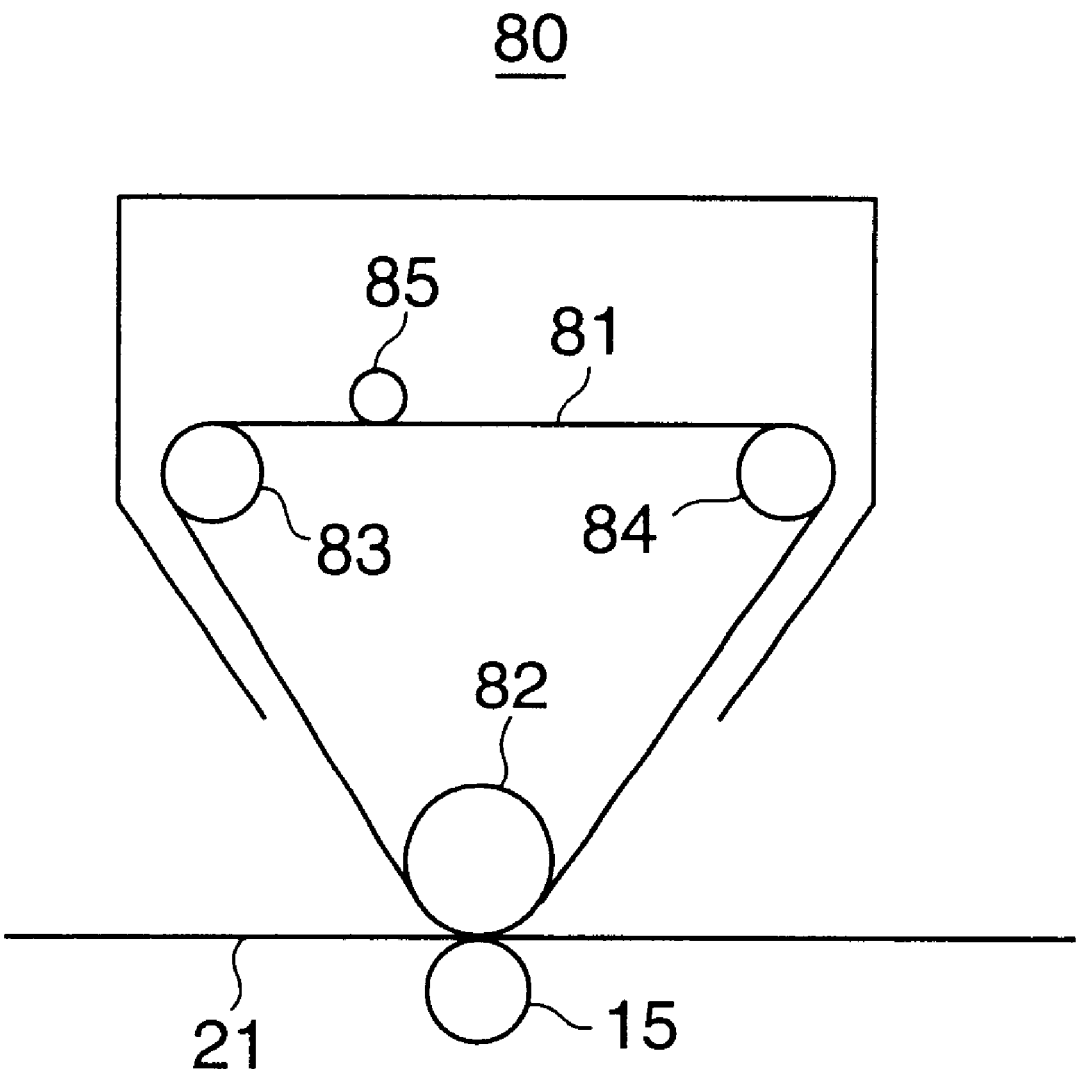
FIG. 4 is a schematic illustration of another setting agent applicator used in the first embodiment of the present invention.

A test was conducted using a setting agent applicator 80 shown in FIG. 4 instead of the setting agent applicator 10 shown in FIG. 1.

Unlike the setting agent applicator 10 shown in FIG. 1, the setting agent applicator 80 shown in FIG. 4 was configured with an application belt 81. The application belt 81 was cycled by being engaged with three supporting rollers 82, 83 and 84. The roller 82 pressed the application belt 81 against the intermediate transfer belt 21. The application belt 81 was made of a polyethylene terephthalate) film having a thickness of about 50 micrometers provided with a surface layer made of foamed ethylene propylene rubber (EPDM) having a thickness of about 1 millimeter. The foamed EPDM included both isolated cells and communicating cells, and the diameter of the cells was in the range from 100 micrometers to 200 micrometers. A supply roller 85 provided in the setting agent applicator 80 contacted the application belt 81 or came close to contacting the application belt 81 so that a predetermined narrow gap was formed there between so as to control the amount of setting agent supplied to the application belt 81.

An inkjet printer using water soluble ink was used as the recording apparatus in which an image was formed on the intermediate transfer belt. As for the recording paper, print paper designated as TYPE6200 manufactured by Ricoh Co., Ltd. was used. In the test, the positional relationship between the supply roller 85 and the application belt 81 was changed. When the supply roller 85 was brought into contact with the application belt 81, the amount of setting agent adhering to the intermediate transfer belt was about 90 $\mu g/cm^2$. When the supply roller 85 was held apart from the application belt 81 forming a gap of about 300 micrometers, the amount of setting agent adhering to the intermediate transfer belt was about 140 $\mu g/cm^2$. In either case, the setting agent adhering to the intermediate transfer belt was in the form of a multi-layered structure, and the layer of the setting agent did not separate from the intermediate transfer belt prior to an ink image being formed on the layer of the setting agent, which resulted in a good quality image.

Figure 5:
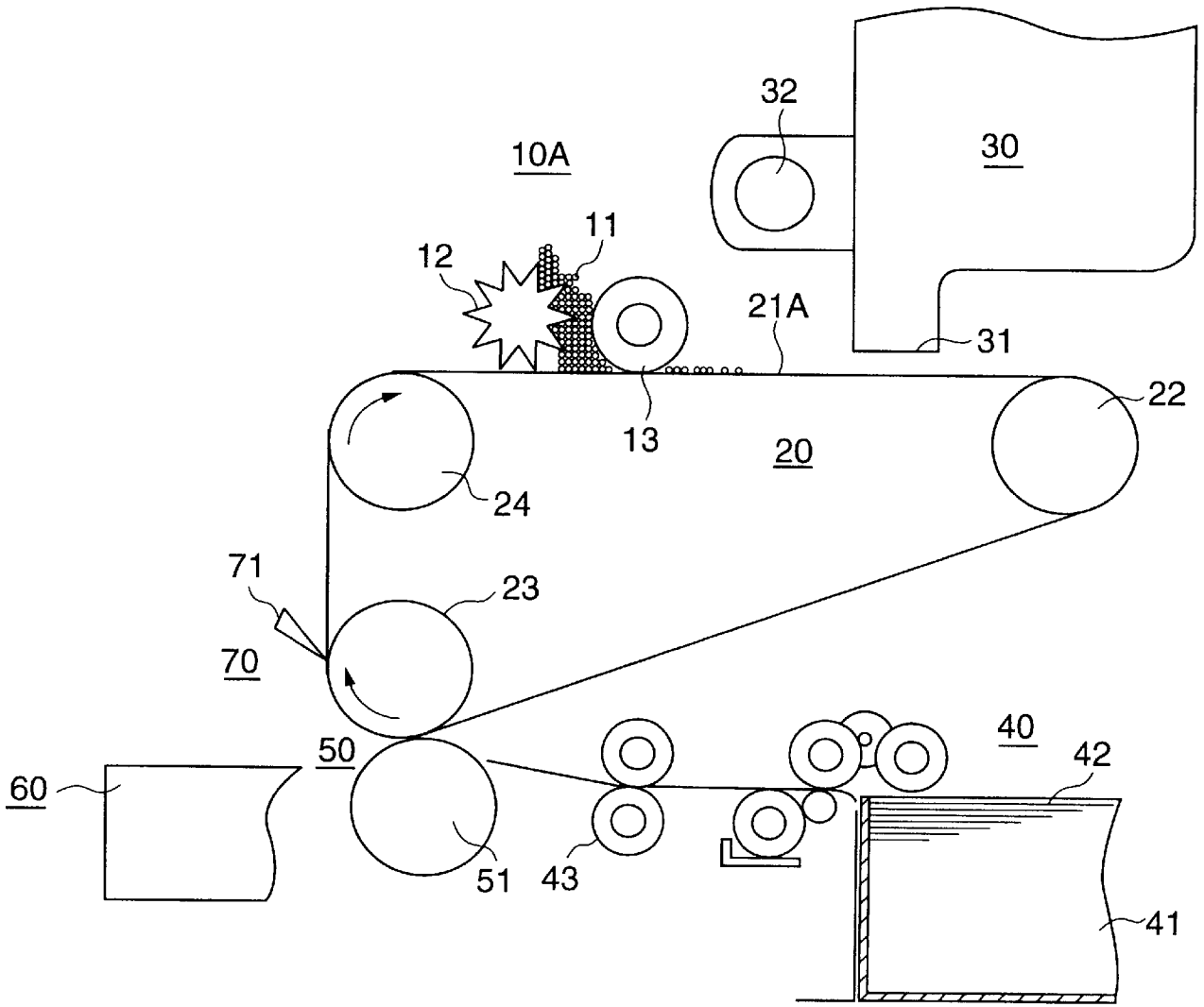
FIG. 5 is a schematic illustration of an inkjet recording apparatus according to a second embodiment of the present invention.

A description will now be given, with reference to FIG. 5, of a second embodiment of the present invention. FIG. 5 is a schematic illustration of an inkjet recording apparatus according to the second embodiment of the present invention. The inkjet recording apparatus according to the second embodiment of the present invention has the same structure as the inkjet recording apparatus according to the first embodiment of the present invention except for the setting agent applicator 10 being replaced by a setting agent applicator 10A and the intermediate transfer belt 21 being replaced by an intermediate transfer belt 21A. In FIG. 5, parts that are the same as the parts shown in FIG. 1 are given the same reference numerals, and descriptions thereof will be omitted.

Figure 6:
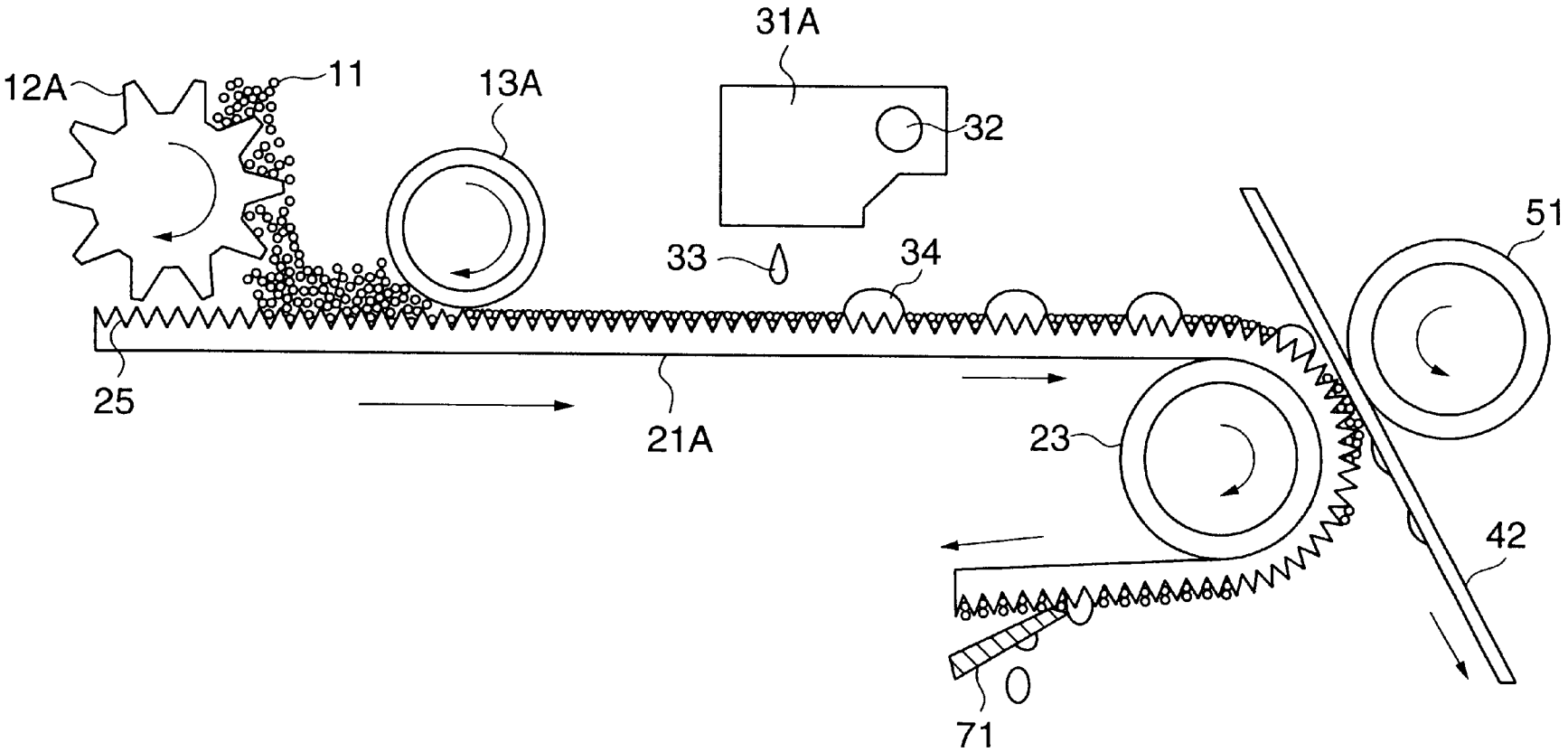
FIG. 6 is a schematic illustration of an image forming operation performed by the inkjet recording apparatus shown in FIG. 5.

A description will now be given, with reference to FIG. 6, of the structure of the intermediate transfer belt 21A according to the present embodiment. The intermediate transfer belt 21A has a surface provided with many depressions 25. The depressions 25 can be formed by sand blasting, or stamping a patterned die onto the surface of the intermediate transfer belt 21A. Each of the depressions 25 has a predetermined depth so that a predetermined amount of setting agent can be accommodated so as to absorb a sufficient amount of liquid contained in the ink droplets projected by the inkjet head 31. Accordingly, if the setting agent absorbs a large amount of liquid, the depth of each of the depressions 25 can be small.

The contour of each of the depressions 25 viewed from above can be various shapes such as a circle, an oval or a polygon. The depressions 25 are distributed on the surface of the intermediate transfer belt 21A according to a regular arrangement or an irregular arrangement close to each other. Accordingly, a predetermined amount of setting agent can be retained on the surface of the intermediate transfer belt with a substantially uniform thickness. Thus, a liquid component contained in ink droplets projected by the inkjet head 31 onto an arbitrary position of the intermediate transfer belt 21A can be absorbed by the setting agent accommodated in the depressions 25, which results in an increase in the viscosity of the ink droplets on the surface of the intermediate transfer belt.

The setting agent applicator 10A comprises a supply roller 12A and an application roller 13A. The amount of the setting agent 11 supplied by the supply roller 12A is set to be exactly equal to or slightly in excess of the necessary amount. The application roller 13A squeezes the setting agent 11 into the depressions 25 formed on the surface of the intermediate transfer belt 21A. Accordingly, there is no need to adjust the pressure applied by the application roller 13A. That is, an appropriate amount of the setting agent can be applied to the surface of the intermediate transfer belt by merely sweeping off the excessive setting agent existing outside the depressions 25.

In the present embodiment, since the setting agent 11 is squeezed into the depressions 25 by a pressing force of the application roller 13A, the setting agent 11 firmly adheres to the surface of the intermediate transfer belt 21A. Thus, the setting agent 11 does not separate from the intermediate transfer belt 21A prior to an ink image being formed on the intermediate transfer belt 21A. However, the transfer characteristic of the ink mage formed on the layer of the setting agent may deteriorate due to strong adhesion of the setting agent to the intermediate transfer belt 21A. Such a problem can be eliminated by forming the intermediate transfer belt 21A with silicon rubber or fluorocarbon rubber which has a good separating characteristic with respect to the setting agent which has been swollen by absorbing the liquid contained in the ink droplets. Alternatively, a separating agent may be applied to the surface of the intermediate transfer belt 21A prior to the application of the setting agent 11 so as to prevent the setting agent from strongly adhering to the surface of the intermediate transfer belt 21 when the ink image formed on the layer of the setting agent 11 is transferred onto the recording paper.

Figure 7B:
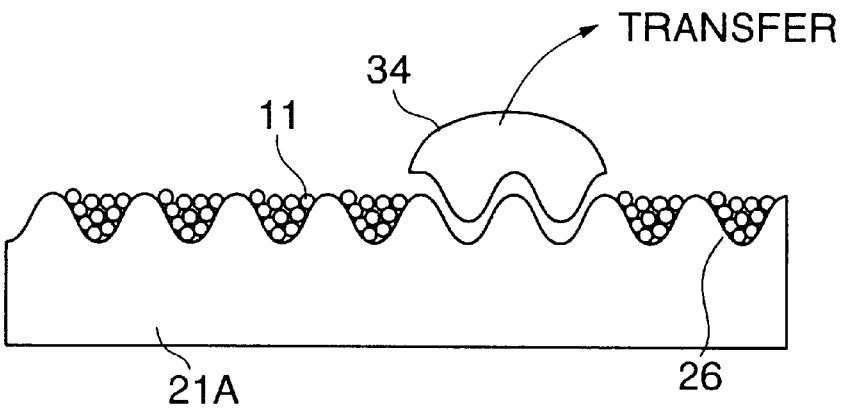
FIGS. 7A and 7B are illustrations of a part of an intermediate transfer belt provided in the inkjet recording apparatus shown in FIG. 5.

Additionally, in order to improve the separation characteristic of the intermediate transfer belt 21A, each of the depressions 26 may be configured with a curved surface as shown in FIG. 7B. According to such a configuration of the depressions 26, an ink image formed on the setting agent 11 accommodated in the depressions 26 can be easily separated from the surface of the intermediate transfer belt 21A.

Additionally, according to the above-mentioned structure of the intermediate transfer belt 21A, removal of the setting agent which has been swollen by the ink droplets and remains on the intermediate transfer belt 21A can be easily removed. That is, the residue of the ink image can be easily removed from the intermediate transfer belt 21A by being swept by the blade 71 since the residue of the ink image protrudes from the surface of the intermediate transfer belt 21 while the setting agent 11 which has not been in contact with the ink droplets is accommodated within the depressions 25 or 26. That is, the residue of the ink image alone can be removed from the intermediate transfer belt 21A by sweeping the protruding ink image with the blade 71. Additionally, since the thickness of the layer of the setting agent 11 is determined by the depth and number of the depressions 25 or 26, an appropriate amount of the setting agent 11 can always be applied to the intermediate transfer belt 21A.

Figure 7A:
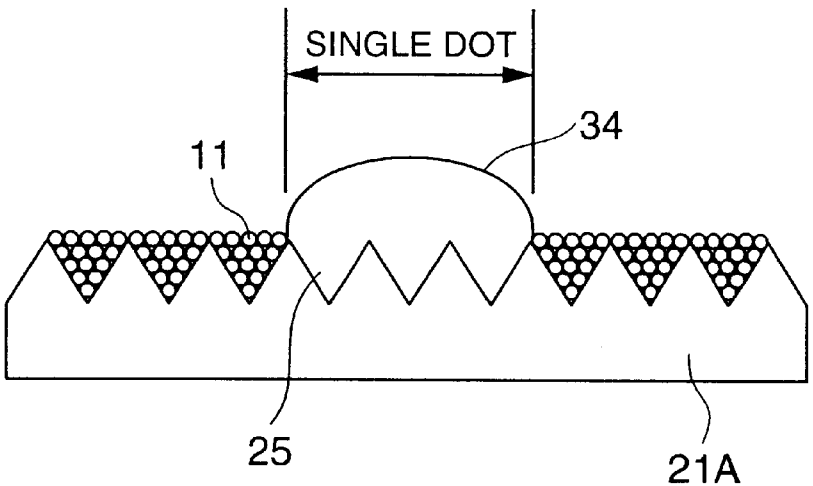

A description will now be given, with reference to FIG. 7A, of the size of area between the depressions 25.

Since the depressions 25 are distributed on the surface of the intermediate transfer belt 21A, there are many areas, where the depressions 25 are not formed, surrounded by the depressions 25. If each of the areas surrounded by the depressions 25 is larger than the size of a contact area (corresponding to the area of a single dot image) of each of the ink droplets 34 on the surface of the intermediate transfer belt 21A, an ink droplet 34 that landed on the area in which no depression is formed does not contact the setting agent 11. Thereby, the liquid component of the ink droplet 34 that landed on the area where no depressions 25 are formed cannot be absorbed by the setting agent, which may cause ink running or incomplete formation of an ink image. In order to solve such a problem, the size of each area where the depressions 25 are not formed must be smaller than the size of the contact area of each of the ink droplets 34.

It should be noted that the size of each of the depressions 25 can be larger than the size of the single dot image which is formed by each of the ink droplets 34. Additionally, the size of each of the depressions 25 must be larger than the size or particle diameter of the setting agent, because if the particle diameter is larger than the size of each of the depressions 25, the setting agent cannot be efficiently placed inside the depressions 25 and as a result the setting agent on the intermediate transfer belt 21A cannot be in the multi-layered structure.

The present invention is not limited to the specifically disclosed embodiments, and variations and modifications may be made without departing from the scope of the present invention.

The present application is based on Japanese priority applications No. 11-078301 filed on Mar. 23, 1999 and No. 11-089921 filed on Mar. 30, 1999, the entire contents of which are hereby incorporated by reference.

What is claimed is:

1. A recording method for recording an image on a recording medium, the image being formed by droplets of a liquid, the recording method comprising the steps of:

supplying a setting agent to a carrier carrying the setting agent, a part of the carrier having a plurality of depressions each receiving a lump of powder of the setting agent, the setting agent being made of a material formed in the form of powder that increases the viscosity of the droplets of the liquid by being brought into contact with the droplets;

forming a visible image on the setting agent carried by the carrier by applying the droplets of the liquid onto the setting agent; and transferring the visible image onto the recording medium.

2. The recording method as claimed in claim 1, wherein the step of supplying comprises the steps of:

applying the setting agent to an application roller having a surface on which the depressions are formed so that the setting agent is received by the depressions; and transferring the setting agent carried by the depressions of the application roller onto an intermediate transfer member which carries and moves the setting agent to a position where the droplets of the liquid are applied.

3. The recording method as claimed in claim 1, wherein the step of supplying comprises the steps of:

applying the setting agent to an intermediate transfer member having a surface on which the depressions are formed so that the setting agent is received by the depressions; and squeezing the setting agent into the depressions of the intermediate transfer member.

4. A recording apparatus for recording an image on a recording medium, the image being formed by droplets of a liquid, the recording method comprising the steps of:

means for supplying a setting agent to a carrier carrying the setting agent, a part of the carrier having a plurality of depressions each receiving a lump of powder of the setting agent, the setting agent being made of a material formed in the form of powder that increases the viscosity of the droplets of the liquid by being brought into contact with the droplets;

means for forming a visible image on the setting agent carried by the carrier by applying the droplets of the liquid onto the setting agent; and means for transferring the visible image onto the recording medium.

5. The recording apparatus as claimed in claim 4, wherein the means for supplying comprises:

means for applying the setting agent to an application roller having a surface on which the depressions are formed so that the setting agent is received by the depressions: and means for transferring the setting agent carried by the depressions of the application roller onto an intermediate transfer member which carries the setting agent to a position where the droplets of the liquid is applied.

6. The recording apparatus as claimed in claim 5, wherein an opening size of each of the depressions formed on the application roller is equal to or greater than twice a particle diameter of the setting agent, and a depth of each of the depressions formed on the application roller is equal to or greater than twice the particle diameter of the setting agent.

7. The recording apparatus as claimed in claim 5, wherein unevenness is provided on the surface of the application roller so that the unevenness serves as the depressions of the application roller.

8. The recording apparatus as claimed in claim 5, wherein at least the outermost portion of the application roller is made of a foamed material so that cells of the foamed material opening in the surface of the application roller serve as the depressions.

9. The recording apparatus as claimed in claim 4, wherein the means for supplying comprises:

means for applying the setting agent to an intermediate transfer member having a surface on which the depressions are formed so that the setting agent is received by the depressions; and means for squeezing the setting agent into the depressions of the intermediate transfer member.

10. The recording apparatus as claimed in claim 9, wherein a bottom of each of the depressions lacks a sharp corner so that the depression is defined by a curved surface.

11. The recording apparatus as claimed in claim 9, wherein an opening size of each of the depressions formed on the intermediate transfer member is equal to or greater than twice a particle diameter of the setting agent, and a depth of each of the depressions formed on the intermediate transfer member is equal to or greater than twice the particle diameter of the setting agent.

12. The recording apparatus as claimed in claim 9, wherein unevenness is provided on the surface of the intermediate transfer member so that the unevenness serves as the depressions of the intermediate transfer member.

13. The recording apparatus as claimed in claim 9, wherein the intermediate transfer member includes a surface layer made of a foamed material so that cells of the foamed material opening in the surface of the intermediate transfer member serve as the depressions.

14. A recording apparatus for recording an image on a recording medium, the image being formed by droplets of a liquid, the recording method comprising the steps of:

means for supplying a setting agent to a carrier carrying the setting agent, a part of the carrier having a plurality of depressions receiving the setting agent, the setting agent being made of a material formed in the form of powder that increases the viscosity of the droplets of the liquid by being brought into contact with the droplets;

means for forming a visible image on the setting agent carried by the carrier by applying the droplets of the liquid onto the setting agent; and means for transferring the visible image onto the recording medium, wherein the means for supplying comprises means for applying the setting agent to an application roller having a surface on which the depressions are formed so that the setting agent is received by the depressions and means for transferring the setting agent carried by the depressions of the application roller onto an intermediate transfer member which carries the setting agent to a position where the droplets of the liquid is applied, and wherein the setting agent is free from contact on the intermediate transfer member before the droplets of the liquid are applied to the setting agent.

15. A recording apparatus for recording an image on a recording medium, the recording apparatus comprising:

a recording head projecting droplets of a liquid toward an image forming position so as to form a visible image;

a carrier carrying and moving a setting agent to a transfer position where the visible image is transferred onto the recording medium so that the setting agent passes through the image forming position before reaching the transfer position, wherein the setting agent is made of a material formed in the form of powder that increases the viscosity of the droplets of the liquid by being brought into contact with the droplets, and the carrier includes a plurality of depressions each of which retains a lump of the setting agent so that a predetermined amount of the setting agent is moved to the image forming position.

16. The recording apparatus as claimed in claim 15, wherein the carrier includes:

an application roller having a surface on which the depressions are formed;

a supply roller supplying the setting agent to the application roller;

a squeezer squeezing the setting agent into the depressions of the application roller;

an intermediate transfer belt receiving the setting agent from the application roller and moving the setting agent to the transfer position through the image forming position;

a roller pressing the intermediate transfer belt against the application roller so that the setting agent in the depressions of the application roller is transferred onto the intermediate transfer belt.

17. The recording apparatus as claimed in claim 16, wherein each of the depressions formed on the surface of the application roller is configured to accommodate a predetermined amount of setting agent so that the setting agent on the intermediate transfer belt forms a powder layer having substantially a multi-layered structure.

18. The recording apparatus as claimed in claim 15, wherein the carrier comprises:

an intermediate transfer belt having a surface on which the depressions are formed;

a supply roller supplying the setting agent to the surface of the intermediate transfer belt; and a squeezing member squeezing the setting agent into the depressions of the intermediate transfer belt by being pressed against the surface of the intermediate transfer belt.

19. The recording apparatus as claimed in claim 18, further comprising a blade contacting the intermediate transfer belt so as to remove the droplets of the liquid remaining on the intermediate transfer belt.

20. A recording apparatus for recording an image on a recording medium, the recording apparatus comprising:

a recording head projecting droplets of a liquid toward an image forming position so as to form a visible image;

a carrier carrying and moving a setting agent to a transfer position where the visible image is transferred onto the recording medium so that the setting agent passes through the image forming position before reaching the transfer position, wherein the setting agent is made of a material formed in the form of powder that increases the viscosity of the droplets of the liquid by being brought into contact with the droplets, and the carrier includes a plurality of depressions each of which retains the setting agent so that a predetermined amount of the setting agent is moved to the image forming position, wherein the carrier comprises an intermediate transfer belt having a surface on which the depressions are formed, a supply roller supplying the setting agent to the surface of the intermediate transfer belt by being pressed against the surface of the intermediate transfer belt, and wherein each of the depressions formed on the surface of the intermediate transfer belt is configured to accommodate a predetermined amount of setting agent so that the setting agent on the intermediate transfer belt absorbs a liquid component of the droplets of the liquid so as to increase the viscosity of the droplets on the intermediate transfer belt.

* * * * *